US005622200A

United States Patent [19]

Schulze

[11] Patent Number: 5,622,200

[45] Date of Patent: Apr. 22, 1997

[54] THERMO-ELECTRIC SAFETY IGNITER WITH REIGNITION LOCK

[75] Inventor: Klaus Schulze, Gernrode, Germany

[73] Assignee: Mertik Maxitrol GmbH & Co., KG, Germany

[21] Appl. No.: 227,719

[22] Filed: Apr. 14, 1994

[51] Int. Cl.[6] ..... F23D 14/72; F23Q 9/12

[52] U.S. Cl. ..... 137/66

[58] Field of Search ..... 137/65, 66, 637.1; 251/68, 70; 431/42, 52, 53, 54, 75

[56] References Cited

U.S. PATENT DOCUMENTS

| | | | |
|---|---|---|---|
| 2,735,439 | 2/1956 | Coffey | 137/66 |
| 2,988,098 | 6/1961 | Thomas | 137/66 |
| 3,002,519 | 10/1961 | Wright et al. | 137/66 |
| 3,303,866 | 2/1967 | Ray | 431/54 |
| 3,348,561 | 10/1967 | MacLennan | 137/66 |
| 3,446,227 | 5/1969 | Grayson | 137/66 |
| 3,597,138 | 8/1971 | Ray | 137/66 |
| 4,081,235 | 3/1978 | van der Veer | 137/66 |
| 4,242,080 | 12/1980 | Tabei | 137/66 |
| 4,442,853 | 4/1984 | Gort | 137/66 |
| 4,543,974 | 10/1985 | Dietiker et al. | 137/66 |

FOREIGN PATENT DOCUMENTS

| | | | |
|---|---|---|---|
| 1124443 | 3/1962 | Germany . | |
| 1127292 | 4/1962 | Germany | 137/66 |
| 1529076 | 8/1973 | Germany . | |
| 124835 | 3/1977 | Germany . | |
| 209021 | 4/1984 | Germany . | |
| 213039 | 8/1984 | Germany . | |
| 1144372 | 3/1969 | United Kingdom | 137/66 |

*Primary Examiner*—George L. Walton
*Attorney, Agent, or Firm*—Harness, Dickey & Pierce, P.L.C.

[57] ABSTRACT

The invention takes as a basis the problem of developing a thermo-electric safety igniter with a reignition lock on a gas valve combination which is suitable for using a rotary slide as main valve for the main gas flow and the pilot gas flow. The problem is solved in that a half-disc, whose ends are located in a notch, is arranged on part of the operating rod intruding into the housing chamber such that when the main valve is closed and the valve head of the safety igniter valve is in the open position, the ends of the half disc cooperate with the notch to prevent opening movement of the main valve. The hoop has a blade or tongue whose length is dimensioned such that the hoop ends are moved out of the notch when the igniter safety valve closes and the main valve remains closed.

The invention refers to a thermo-electric safety igniter with a reignition lock on a gas valve combination for a gas heating furnace or similar for controlling the main gas flow and the pilot gas flow.

11 Claims, 1 Drawing Sheet

THERMO-ELECTRIC SAFETY IGNITER WITH REIGNITION LOCK

BACKGROUND AND SUMMARY OF THE INVENTION

The invention refers to a thermo-electric safety igniter with a reignition lock on a gas valve combination for a gas heating furnace or similar for safely preventing reignition following switching-off before the safety igniter is again ready for operation.

Safety igniters of this type are known. Their layout with reignition locks is recommended for safety reasons or if necessary, imperatively prescribed. An example of such an arrangement is described in DD-PS 1 24 835 where its mode of operation is shown generally valid in schematic form (FIGS. 7 to 13). Generally with the known reignition locks, a so-called cam is attached to both the main valve head and the safety igniter valve head. Both cams have claw-shaped bevel-edges which together form a break-away coupling. The break-away coupling cannot be released; when withdrawing the operating rod in the open direction of the main valve, the pilot gas valve is closed whereby of course a foreseen detent coupling is released between the safety igniter valve head and the valve rod of the safety igniter magnets. The valve rod remains in its position until complete de-energization of the safety igniter magnets because the anchor is held fast further by the magnet yoke. If the magnet is de-energized, the valve rod is pushed under the influence of a compression spring until the detent coupling is re-established.

With this solution it is disadvantageous that complicatedly shaped individual components are necessary for its realization and that further the cams form a relatively rigid connection with each other, a relatively rigid control in their respective axial direction and a fixed connection with their respective valve heads. Due to the layout of the various components of the housing, there is the danger that the valve heads are no longer parallel to the valve seats and the valves cannot close tightly or a very high manufacturing accuracy is necessary which is not desired for mass-production. Further it is disadvantageous that this solution is not suitable in connection with a rotary slide as main valve for the main gas flow and pilot gas flow.

The given invention in the patent claim takes as a basis the problem of developing a thermo-electric safety igniter with a reignition lock on a gas valve combination which is suitable for using a rotary slide as main valve for the main gas flow and the pilot gas flow. Thereby it should have the simplest possible layout and should be suitable for use in mass-production.

According to the invention, the problem is solved by the named characteristics in the marked part of the patent claim.

BRIEF DESCRIPTION OF THE DRAWING

The invention is described in detail with a drawing and an example of operation. There is.

Figure 1:
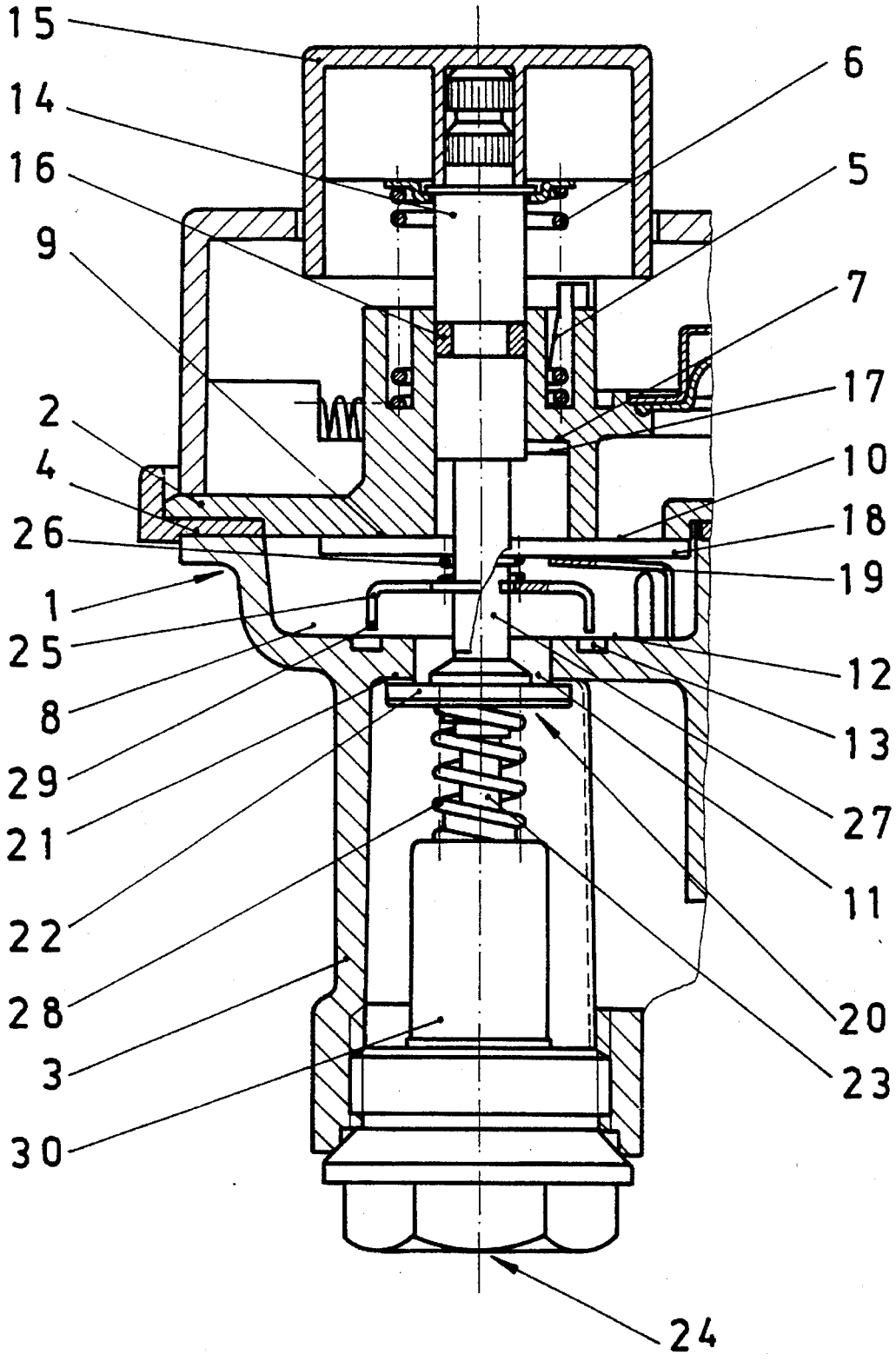
FIG. 1 a section through a safety igniter according to the invention, schematic view.

The thermo-electric safety igniter is installed in a housing (1) which comprises an upper part (2) and a lower part (3) between which a flat gasket (4) guarantees the external tightness. The location of the disconnecting point is not arbitrary and depends on the construction of further functional units not touched here.

An operating rod (14) is pivoted on a support point of upper part (2) and has longitudinal freedom depending on a guide contour (5) described in detail below, whereby the necessary gas-tightness is guaranteed for example by a round ring (16). Operation is manual via a control knob (15) connected permanently to the control rod (14). Movement in the longitudinal direction is thereby only possible against the force of a return spring (6) supported in upper part (2).

The starting position to be assumed, under the force of the return spring (6) is achieved by a transverse pin (17) Dressed into the operating rod (14). The pin is located inside housing (1) and lies on a ledge (7) found in upper part (2). The operating rod (14) reaches with its end inside the lower part (3).

A rotary slide (18) is controlled by the operating rod (14) in the direction of rotation, which is pressed against a sealing surface (9) formed by upper part (2) by a half-disc shaped spring (19), which is located in housing chamber (8) formed by upper part (2) and lower part (3) and supported in lower part (3). An aperture (10) for the main gas flow and an aperture (not shown) for the pilot gas flow are found in the sealing surface (9).

The guide contour (5) described above is shaped such that movement of the operating rod (14) in the longitudinal direction is only possible if, due to the position of the rotary slide (18), the aperture for the pilot gas flow is open, whereby the minimum size of the opening diameter is dimensioned such that only the necessary amount of pilot gas for pilot gas flow through.

Aligned to rotary slide (18) and thus in the extension of the operating rod (14), housing chamber (8) has an opening (11) which forms the valve seat (21) of a safety igniter valve (20) on the opposite side of housing chamber (8) and which can be gas-tight sealed by a valve head (22).

The safety igniter valve (20) is influenced by a thermo-electric safety igniter magnet arranged gas-tightly in a bearing of lower part (3). The magnet has an electrical connection (24) of a thermo-element (not shown) for the pilot gas flame. An energized or de-energized electro-magnet, depending on the temperature thermo-element, attracts an anchor which is rigidly connected to a valve rod (23) on which the valve head (22) is attached. The construction and manner of operation of the safety igniter magnet (30) however, is well known to the expert so that a description of further details can be dispensed with. Special attention should be drawn however that a return spring (28) endeavours to withdraw the anchor from the electro-magnet via the valve head (22) serving as a spring bearing.

A half-disc (25), freely movable in the longitudinal direction of the operating rod (14), is located on that part of operating rod (14) intruding into the housing chamber (8). The half-disc (25) is guided, however, through the operating rod (14) in the rotation direction. The half-disc (25) is loaded in the direction of the safety igniter valve (20) by a spring (26) supported on the rotary slide (18). The working surface (12) formed by the turning movement of the half-disc (25) on the surface of housing chamber (8) is interrupted by a slot (13) in which both half-disc ends (29) are located due to the effect of spring (26), if the apertures (10) for the main and pilot gas flows are closed by the rotary slide (18) in the upper part (2) and the valve head (22) of the safety igniter valve (20) is in the open position.

The half-disc (25) has also a tongue (27) protruding axially in the direction of valve head (22) of safety igniter valve (20). The tongue's length is dimensioned such that both half-disc ends (29) are outside the slot (13) when the safety igniter valve (20) and the apertures (10) are closed.

The mode of operation of the reignition blocking is no different from known existing comparable solutions. If the pilot gas of the gas furnace is to be ignited, then the operating rod (14) is turned so far by control knob (15) such that the aperture in the upper part (2) for the pilot gas is sufficiently opened. The aperture (10) for the main gas flow is closed however, whereby at the same time, the otherwise available lock is overwound against being pressed down by guidance contour (5), and consequently is pressed in so far that its end is on the anchor of the safety igniter magnets (20) via the valve head (22) and the valve rod (23) of the safety igniter valve (20). The pilot gas flows through the open safety igniter valve (20) and open aperture to the pilot burner and can be ignited. If one releases the control knob (15) after a certain time then, providing that the safety igniter magnet (30) is energized, then the valve rod (23) and the valve head (22) of the safety igniter valve (20) remain in their positions and only the operating rod (14) slides upwards. Thereby the generally termed "ready-to-operate" position is reached in which only the pilot flame burns.

By turning control knob (15) further, also aperture (10) for the main gas flow is opened until the maximum opening diameter is reached which is signalized by a stop whereby the so called "operate" position is reached. Obviously if turning the control knob (15) further in the "operate" position, the operating rod (14) is prevented from being pressing down by guidance contour (5) already named above.

If the gas furnace is switched off, whereby the control knob (15) of the gas valve combination is turned back to its starting position, which is also signalized by a stop, the aperture (10) for the main gas flow and the aperture for the pilot gas flow is closed by rotary slide (18). Due to the still open safety igniter valve (20), because it is energized, the half-disc (25) with both its ends (29) falls into slot (13) and thus prevents the control knob (15) being turned and thereby a re-opening of the aperture for the pilot gas and/or aperture (10) for the main gas by rotary slide (18). Only when the safety igniter magnet (30) is no longer energized, is the safety igniter valve (20) closed and valve head (22) moves both half-disc ends (29) out of slot (13) by tongue (27) so that re-ignition can take place.

I claim:

1. A thermo-electric safety igniter for a gas valve adapted to be used with gas fired apparatus, said gas valve including a housing having an operating rod axially and rotatably movably supported therein, valve means controlled by said operating rod to selectively control main gas flow and pilot gas flow to said apparatus, said thermo-electric safety igniter comprising:

a first member non-rotatably supported on said operating rod for rotary movement therewith, said first member being freely axially movable with respect to said operating rod;

interlock means provided on said housing for cooperating with said first member to prevent rotation of said operating rod from a position in which said valve means prevents main gas flow and pilot gas flow when said first member is in a first position; and releasing means supported in said housing, said release means being operative to move said first member from said first position to a second position in response to a predetermined condition whereby said operating rod may be rotated to move said valve means into a position allowing flow of said pilot gas.

2. A thermo-electric safety igniter for a gas valve as set forth in claim 1 wherein said first member includes biasing means operative to urge said first member into said first position when said operating rod is moved to close said valve means.

3. A thermo-electric safety igniter for a gas valve as set forth in claim 1 wherein said releasing means includes a safety igniter magnet operative to effect movement of a safety igniter valve between an open and closed position.

4. A thermo-electric safety igniter for a gas valve as set forth in claim 3 wherein movement of said safety igniter valve into said closed position operates to move said first member into said second position thereby enabling rotational movement of said operating rod.

5. A thermo-electric safety igniter for a gas valve as set forth in claim 4 wherein said interlocking means comprise at least one recess provided in a surface of said housing, said first member including a portion received within said recess when said first member is in said first position.

6. A thermo-electric safety igniter for a gas valve as set forth in claim 5 wherein said first member includes a second portion engageable with said safety igniter valve when said safety igniter valve moves into said closed position, said engagement being operative to move said first member into said second position thereby enabling rotary movement of said operating rod.

7. A gas valve having a reignition lock for controlling gas flow from a source to a main burner and a pilot burner, said gas valve comprising:

a housing having a gas inlet and a gas outlet;

a control rod axially and rotatably movably supported in said housing;

a valve member secured to said control rod and rotatable therewith, said control rod being operative to rotate said valve member from a first position in which said valve member prevents gas flow from said inlet to said outlet to a second position in which said valve member allows gas flow from said inlet to said outlet to supply gas to said pilot burner and to a third position in which said valve member allows gas flow from said inlet to said outlet to supply gas to said main burner and said pilot burner;

a safety igniter valve assembly disposed within said housing between said inlet and outlet, said safety igniter valve assembly including a safety valve member and an electromagnet operative to maintain said safety valve member in an open position in response to heat generated when said pilot burner is lit and to allow said safety valve member to move into a closed position in the absence of heat from said pilot burner, an interlock assembly for preventing rotation of said control rod to move said valve member out of said first position when said safety valve member is in an open position, said interlock assembly including a first abutment member non-rotatably and axially movably supported on said control rod and a second abutment member provided on said housing and engageable with said first abutment member when said valve member is moved into said first position and said safety valve member is in said open position, said safety valve member being operative to move one of said first and second abutment members out of engagement with the other when said safety valve member moves from said open position to said closed position in response to de-energization of said electromagnet.

8. A gas valve as set forth in claim 7 wherein said interlock assembly further includes a biasing member operative to axially urge said first abutment member toward said second abutment member.

9. A gas valve as set forth in claim 7 wherein said valve member is a rotary slide valve.

10. A gas valve as set forth in claim 7 wherein said first abutment member includes a half disc having at least one generally radially outwardly extending arm engageable with said second abutment member provided on said housing.

11. A gas valve as set forth in claim 10 wherein said second abutment member comprises a slot in said housing adapted to receive said arm.

* * * * *